US009174350B2

(12) United States Patent
Park et al.

(10) Patent No.: US 9,174,350 B2
(45) Date of Patent: Nov. 3, 2015

(54) MULTI-BLADE ELECTRIC ROTARY RAZOR

(75) Inventors: Young Ho Park, Gyeonggi-Do (KR); Jae Jun Lee, Seoul (KR)

(73) Assignee: DORCO CO., LTD, Gyeonggi-Do (KR)

( * ) Notice: Subject to any disclaimer, the term of this patent is extended or adjusted under 35 U.S.C. 154(b) by 156 days.

(21) Appl. No.: 13/819,132

(22) PCT Filed: Aug. 30, 2011

(86) PCT No.: PCT/KR2011/006414

§ 371 (c)(1),
(2), (4) Date: Feb. 26, 2013

(87) PCT Pub. No.: WO2012/030146

PCT Pub. Date: Mar. 8, 2012

(65) Prior Publication Data

US 2013/0152399 A1 Jun. 20, 2013

(30) Foreign Application Priority Data

Aug. 30, 2010 (KR) ..... 10-2010-0083911

(51) Int. Cl.

| | |
|---|---|
| ***B26B 19/14*** | (2006.01) |
| ***B26B 19/38*** | (2006.01) |
| ***B26B 21/00*** | (2006.01) |
| ***B26B 21/40*** | (2006.01) |

(52) U.S. Cl.

CPC ..... *B26B 19/145* (2013.01); *B26B 19/14* (2013.01); *B26B 19/3853* (2013.01); *B26B 21/00* (2013.01); *B26B 21/4081* (2013.01)

(58) Field of Classification Search

CPC ..... B26B 19/14; B26B 19/145; B26B 21/00; B26B 19/3853; B26B 21/4081; B26B 19/141; B26B 19/143

USPC ..... 30/42, 40, 34.1, 50, 346.5, 346.57, 30/43.4, 43.6, 45

See application file for complete search history.

(56) References Cited

U.S. PATENT DOCUMENTS

| | | | | |
|---|---|---|---|---|
| 2,247,661 | A | 7/1941 | Moskovics et al. | |
| 2,839,829 | A * | 6/1958 | Knapp | 30/43.4 |
| 3,800,417 | A * | 4/1974 | Tietjens | 30/43.6 |
| 4,294,010 | A * | 10/1981 | Chen et al. | 30/42 |
| 4,490,907 | A | 1/1985 | Benedictus | |
| 4,899,442 | A | 2/1990 | Horii et al. | |
| 5,301,425 | A * | 4/1994 | Ferraro | 30/42 |
| 2006/0064875 | A1 * | 3/2006 | Follo et al. | 30/34.1 |

FOREIGN PATENT DOCUMENTS

| | | |
|---|---|---|
| WO | WO2004087382 A1 | 10/2004 |
| WO | WO2007116397 A1 | 10/2007 |

* cited by examiner

*Primary Examiner* — Ghassem Alie

(74) *Attorney, Agent, or Firm* — AKC PATENTS, LLC; Aliki K. Collins

(57) ABSTRACT

The present invention relates to a multi-blade electric rotary razor which comprises a razor blade cartridge turned by a motor, and at least one pair of razor blade assemblies disposed at an equal-angle distance at the razor blade cartridge along a direction in which the razor blade cartridge rotates, at least one pair of razor blades (hereinafter referred to as first razor blades) being arranged in an overlapping manner at a predetermined distance at the razor blade assembly along a radius direction of the razor blade cartridge. The electric rotary razor of the present invention has a structure of a wet shaver where multiple razor blades are arranged, and uses the motor to turn the razor blade cartridge during shaving for user convenience and thorough shaving. The multi-blade razor blade assembly alleviates a dermal stimulation, minimizes a possibility of a scar, and does not require shaving cream, making shaving convenient and unhindered by time and space.

13 Claims, 7 Drawing Sheets

MULTI-BLADE ELECTRIC ROTARY RAZOR

CROSS-REFERENCE TO RELATED APPLICATION

This application claims the benefit of Korean Patent Application No. 10-2010-0083911, filed on Aug. 30, 2010 in the Korean Intellectual Property Office, the disclosure of which is incorporated herein by reference.

TECHNICAL FIELD

The present invention relates to a razor, and more particularly, to an electric rotary razor which has a shape of a dry razor, but includes multi-blades, and thus, can be easily used in wet shaving as well as in dry shaving and has a improved shaving performance.

BACKGROUND ART

Generally, a razor can be categorized into a wet type and a dry type.

In the wet type razor, a cutting part of a blade tightly contacts user's skin, and thus, the wet type razor provides an outstanding hair cutting performance. However, the wet type razor can scar a wound on a user's skin, depending on the skin state of the user or when force applied by the user exceeds a proper limit during the shaving.

The dry razor is operated by a motor or the like, and can be used more safely than the wet razor. This can be achieved by installing a safety-net such that the cutting part of a blade does not directly contact user's skin. Therefore, the dry razor is safer and can be used more conveniently than the wet razor. On the other hand, because the safety-nut or the like is installed, a blade does not tightly contacts user's skin, and thus, the hair-cutting performance of the dry razor is inferior a little when compared to the wet type razor.

DISCLOSURE OF INVENTION

Accordingly, the present invention is directed to provide a multi-blade electric rotary razor, which substantially obviates one or more problems due to limitations and disadvantages of the related art. An aspect of the present invention is directed to provide a multi-blade electric rotary razor, which realizes an outstanding hair cutting performance of a wet razor, and can be conveniently used regardless of time and space.

Moreover, another aspect of the present invention is directed to provide a multi-blade electric rotary razor, which is operated by a motor, has a multi-blade structure of a wet type razor, and thus, can inhibit stimulation applied to user's skin and realize an outstanding hair cutting performance.

To achieve these and other advantage and in accordance with the purpose of the invention, as embodied and broadly described herein, there is provided a multi-blade electric rotary razor, which includes a razor blade cartridge turned by a motor; and at least two razor blade assemblies disposed at an equal-angle distance at the razor blade cartridge along a rotary direction of the razor blade cartridge, wherein, the razor blade assembly comprises at least two razor blades (hereinafter referred to as a first razor blade) arranged in an overlapping manner at a predetermined distance along a radius direction of the razor blade cartridge.

At least two other razor blades (hereinafter referred to as a second razor blade) arranged in an overlapping manner at a predetermined distance along a radius direction of the razor blade cartridge may be further comprised in the razor blade assembly, and blades of the first razor blade and blades of the second razor blade may be disposed to face each other.

Moreover, the razor blade cartridge may rotate in a forward direction and a rearward direction, and the blades of the first razor blade or the blades of the second razor blade may be disposed to face a rotary direction of the razor blade cartridge.

Also, the razor blade cartridge may comprises a bottom housing coupled to the motor to rotate depending on an operation of the motor; a holding part formed in a front surface of the bottom housing to accommodate razor blades; a top housing coupled to the bottom housing to surround a periphery of the bottom housing; and a housing cover coupled to a central portion of the bottom housing, the holding part is extended in a radius direction of the bottom housing, and at least two holding parts may be disposed along a circumference direction of the bottom housing.

Here, the top housing surrounds an end portion of the holding part in a position adjacent to an outer circumference surface of the bottom housing, the housing cover surrounds other end portion of the holding part in a central portion of the bottom housing, and thus, the razor blades accommodated in the holding part are fixed to the holding part.

Moreover, the electric rotary razor may further comprise a coupling groove formed in an inner surface of the other end portion of the holding part; and a hooks extending from an inner surface of the housing cover to a lower portion, wherein, the hook is coupled to the coupling groove to fix the housing cover to the bottom housing.

Here, the housing cover may be manufactured of a material having lubricity.

Also, the motor may turn the razor blade cartridge in a forward direction or a rearward direction, or alternately turn the razor blade cartridge in a forward direction and a rearward direction.

Here, the electric rotary razor may further comprise a circuit board on which a control circuit controlling the motor and a switch module are mounted, and thus, the motor is driven according to a control of the control circuit to control a rotary direction of the razor blade cartridge.

The electric rotary razor may further comprise a cartridge cover disposed for surrounding a periphery of the razor blade cartridge to move in a lengthwise direction of a rotary shaft of the razor blade cartridge, and as the cartridge cover moves along the lengthwise direction of a rotary shaft of the razor blade cartridge, an end portion of the cartridge cover becomes closer to or farther away from a front surface of the razor blade cartridge.

Moreover, the electric rotary razor may further comprise a spring providing the razor blade cartridge with elastic force operating in a lengthwise direction of a rotary shaft of the razor blade cartridge, and the elastic force of the spring brings the razor blade cartridge into contact with skin with constant force to maintain the contact state.

ADVANTAGEOUS EFFECTS

Because the multi-blade electric rotary razor according to embodiments of the present invention has a structure of a wet razor where multiple razor blades are arranged and uses a motor to turn the razor blade cartridge during shaving, the multi-blade electric rotary razor is convenient for use and can provide thorough shaving. Moreover, the multi-blade razor blade assembly alleviates a dermal stimulation, and thus, can minimize a possibility of a scar. Particularly, the multi-blade electric rotary razor does not require shaving cream, and thus, can be conveniently used regardless of time and space.

BRIEF DESCRIPTION OF DRAWINGS

The accompanying drawings, which are included to provide a further understanding of the invention and are incorporated in and constitute a part of this application, illustrate embodiments of the invention and together with the description serve to explain the principle of the invention. In the drawings.

Figure 1:
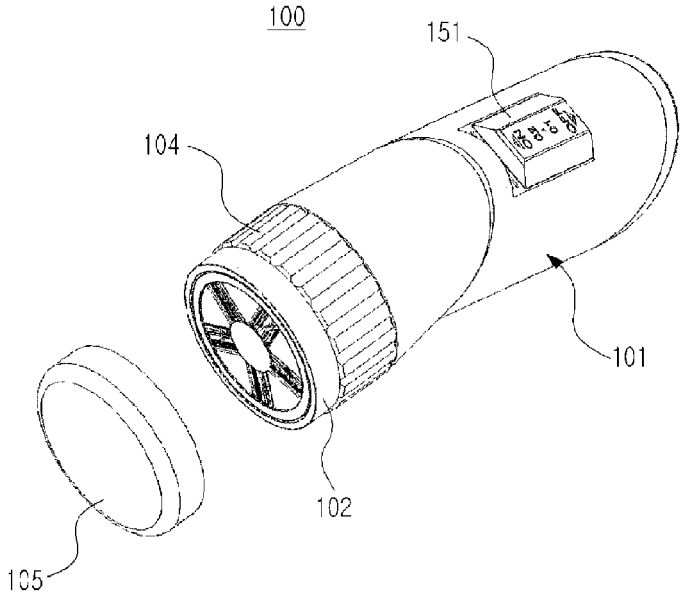
FIG. 1 is a perspective view illustrating an electric rotary razor according to an embodiment of the present invention.
Figure 2:
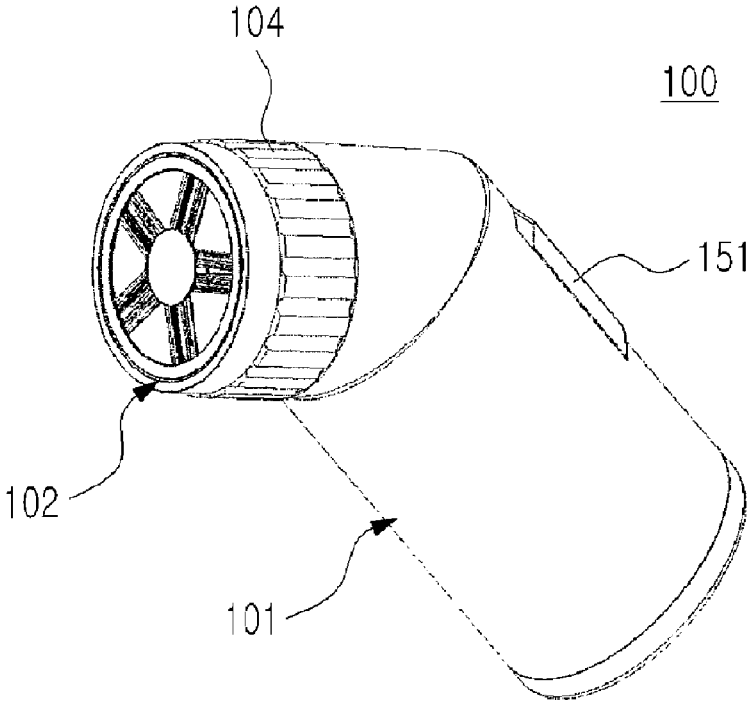
FIGS. 2 and 3 are perspective views of the electric rotary razor, which is shown in FIG. 1, seen in different directions.
Figure 3:
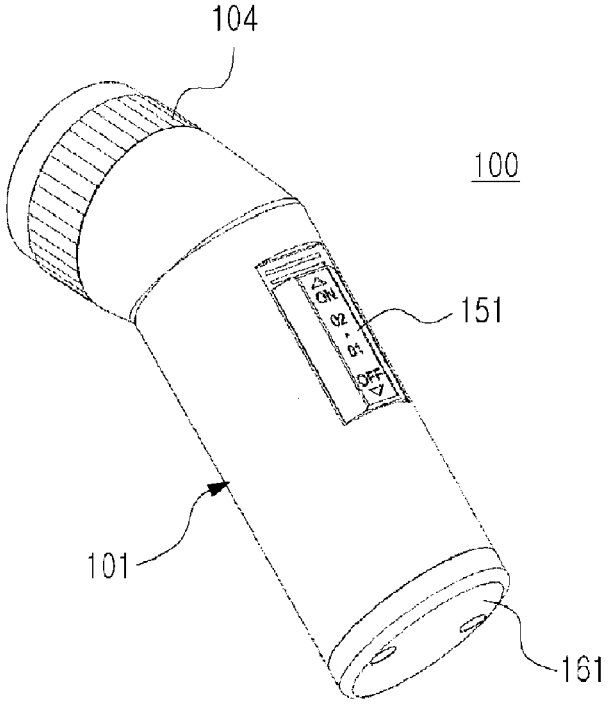
Figure 4:
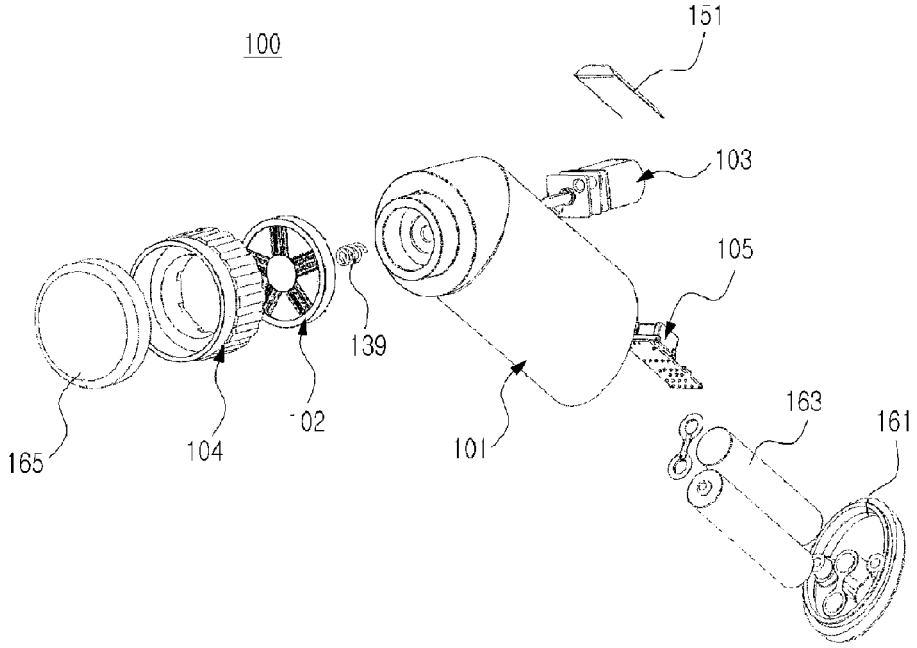
FIGS. 4 and 5 are exploded perspective views respectively illustrating the electric rotary razor shown in FIG. 1.
Figure 5:
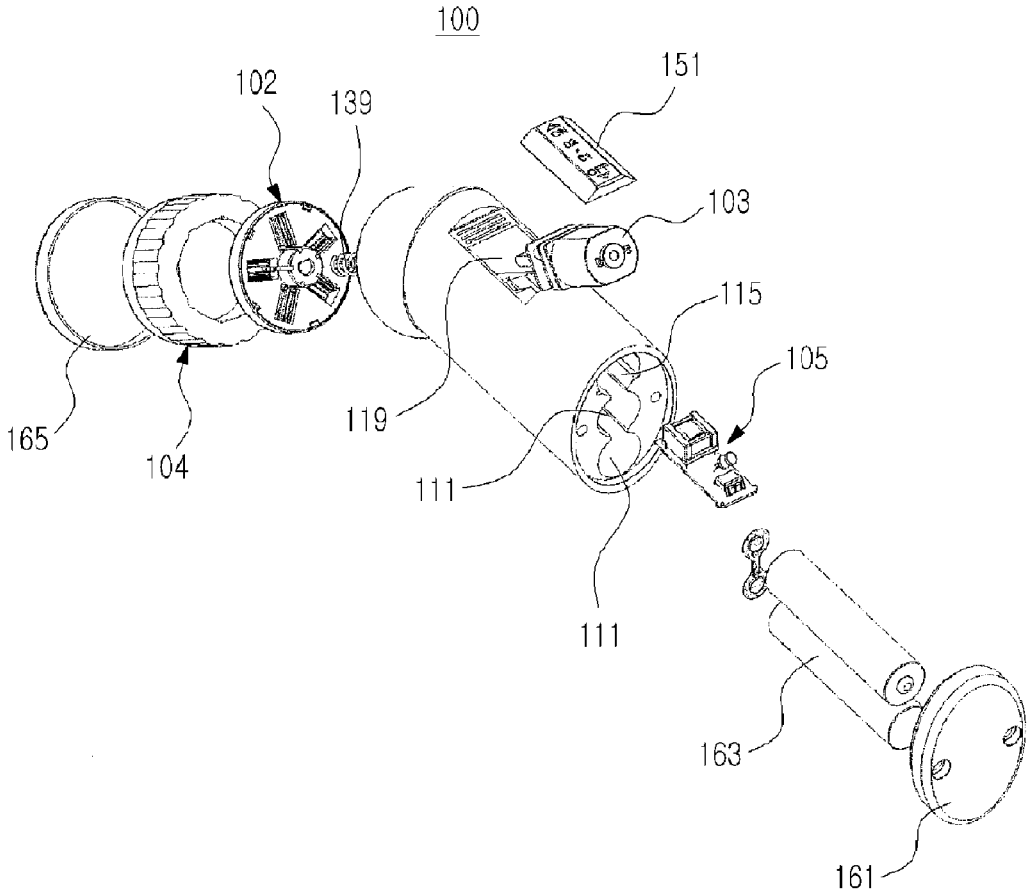

| Descriptions of reference numbers | |
|---|---|
| 100: electric rotary razor | 101: body |
| 102: razor blade cartridge | 121a: top housing |
| 121b: housing cover | 123: bottom housing |
| 125: razor blade assembly | 125a: first razor blade |
| 125b: second razor blade | 103: motor |
| 104: cartridge cover | |

MODES FOR CARRYING OUT THE INVENTION

Reference will now be made in detail to the exemplary embodiments of the present invention, examples of which are illustrated in the accompanying drawings. Wherever possible, the same reference numbers will be used throughout the drawings to refer to the same or like parts. Hereinafter, embodiments of the present invention will be described in detail with reference to the accompanying drawings.

As shown in FIGS. 1 to 5, in the electric rotary razor 100 according to the present invention, at least two razor blade assemblies 125 (shown in FIG. 6) are disposed at an equal-angle distance at a razor blade cartridge 102 turned by a motor 103. Also, the razor blade assembly 125 includes at least two razor blades 125*a* (hereinafter referred to as a first razor blade 125*a*) arranged in an overlapping manner at a predetermined distance along a radius direction of the razor blade cartridge 102. If the first razor blade 125*a* is configured with three or more razor blades, the razor blades configuring the first razor blade 125*a* may be disposed at an equal distance. Here, a blade of the first razor blade 125*a*, that is, a portion cutting hair, may be disposed so as to face a rotary direction of the razor blade cartridge 102.

The electric rotary razor 100 includes a battery stored groove 111 extended from an end portion of a body 101 such that a battery 163 is inserted into the battery stored groove 111, and a cap 161 is couple to the end portion of the body 101 to close the battery stored groove 111. Moreover, a board stored part 115 is formed in one side of the battery stored groove 111 to accommodate a circuit board 105 on which a control circuit, a switch module, or the like are mounted.

A motor stored groove 119 is formed in an outer circumference surface of the body 101, and thus, a motor 103 turning the razor blade cartridge 102 is accommodated in the motor stored groove 119, and the motor stored groove 119 is closed by a switch member 151. The switch member 151 is coupled to a switch module on the circuit board 105, inside the body 101. A user who wants to change an operation mode of the electric rotary razor 100 operates the switch member 151.

A driving shaft of the motor 103 protrudes to other end portion of the body 101, and the razor blade cartridge 102 is coupled to an end portion of the driving shaft to be turned by the motor 103. The razor blade cartridge 102 is rotatably locked in the body 101 by a cartridge cover 104, and a protective cap 165 is coupled to an end portion of the cartridge cover 104 to protect the razor blade cartridge 102. A spring 139 is coupled to an outer circumference surface of the driving shaft of the motor 103 to provide the razor blade cartridge 102 with elastic force. The razor blade cartridge 102 is configured so as to advance and retreat in a lengthwise direction of the rotary shaft during shaving, depending on force applied by a user, and elastic force of the spring 139 brings the razor blade cartridge 102 into contact with skin with constant force to maintain the contact state.

Figure 6:
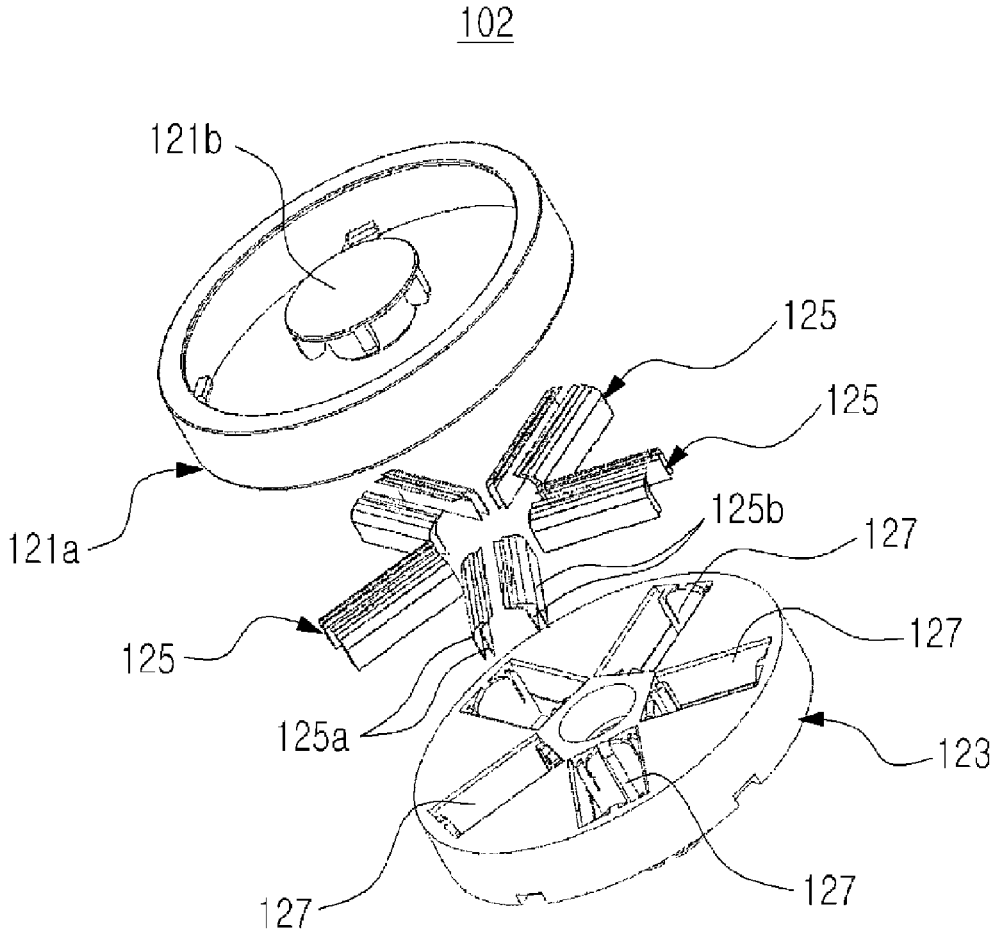
FIGS. 6 and 7 are exploded perspective views respectively illustrating a razor blade cartridge of the electric rotary razor shown in FIG. 4.
Figure 7:
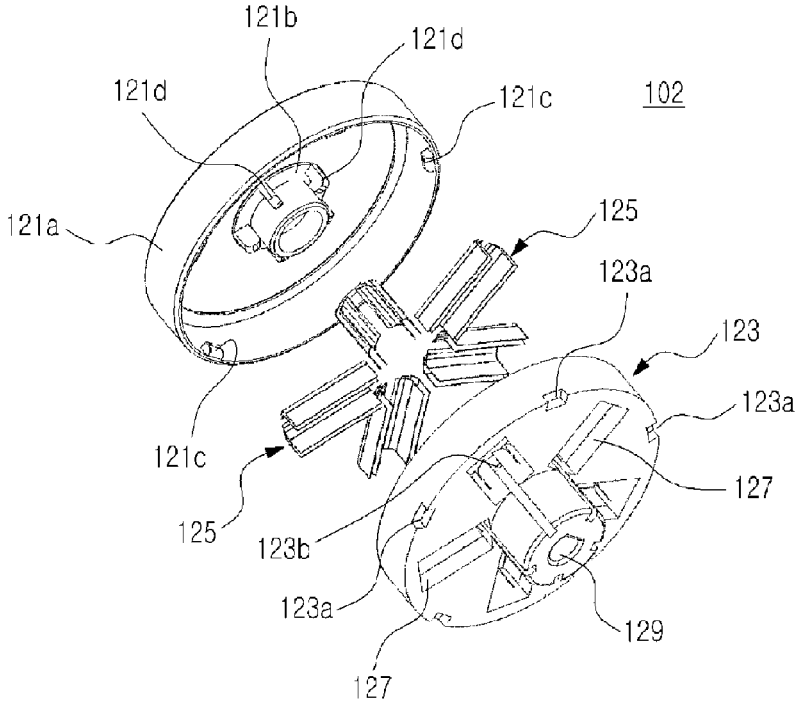

Further referring to FIGS. 6 and 7, the razor blade cartridge 102 includes a bottom housing 123, a top housing 121*a* and a housing cover 121*b*, and the razor blade assembly 125 is disposed in the bottom housing 123.

A driving hole 129 coupled to the driving shaft of the motor 103 is formed in a rear surface of the top housing 123. The driving hole 129 may be sufficiently deep such that even though the razor blade cartridge 102, and more particularly, the bottom housing 123 advances and retreats in a lengthwise direction of the rotary shaft, the bottom housing 123 keeps connected with the driving shaft.

A holding part 127, in which the razor blade assembly 125 is disposed, is formed in a front surface of the top housing 123. The razor blade assembly 125, as described above, includes at least two more razor blades 125*a* (the first razor blade 125*a*) arranged in an overlapping manner at a predetermined distance along a radius direction of the razor blade cartridge 102. In other words, a blade of the first razor blade 125*a* is extended along a radius direction of the razor cartridge 102 to be arranged, and faces a rotary direction of the razor blade cartridge 102. Also, the first razor blade 125*a* is formed in a bent shape so as to be easily mounted on the holding part 127, and slits supporting both end sides of the first razor blade 125*a* may be formed in an inner surface of the holding part 127.

Moreover, the razor blade assembly 125 may include a second razor blade 125*b* facing the first razor blade 125*a*. In the second razor blade 125*b*, at least two more razor blades are arranged in an overlapping manner at a predetermined distance along a radius direction of the razor blade cartridge 102. Here, the first razor blade 125*a* and the second razor blade 125*b* have substantially a same shape, and are arranged so as to be symmetrical with each other, and thus, configures the razor blade assembly 125. Therefore, if the first razor blade 125*a* is configured with three or more razor blades, the second razor blade 125*b* has to be configured with razor blades corresponding to the number of the razor blades of the first razor blade 125*a*, and the razor blades configuring the second razor blade 125*b* may be arranged at a predetermined distance. The second razor blade 125*b* is mounted on the holding part 127 with the first razor blade 125*a*.

In the embodiment, the first razor blade 125*a* and the second razor blade 125*b*, each of which includes one pair of razor blades, are described and shown, but the number of the razor blades configuring the first razor blade 125*a* or the second razor blade 125*b* may be three or more. When the razor blades configuring the first razor blade 125*a* or the second razor blade 125*b* are arranged in an overlapping manner at a predetermined distance, the distance may be in a range of from 0.3 mm to 1.0 mm. Also, the razor blades of the first and second razor blades 125*a* and 125*b* may be disposed on the same plane as a front surface of the razor blade cartridge 102, or may be disposed on a plane lower or higher than the same plane as the front surface of the razor blade cartridge 102 by a range of 0.1 mm or less.

Because the first and second razor blades 125*a* and 125*b* are disposed so as to face each other, it is possible to shave even though the razor blade cartridge 102 rotates in any direction. To provide a detailed description on this, if the first razor blade 125*a* cuts hair when the razor blade cartridge 102 rotates in a first direction (hereinafter referred to as a forward direction), when the razor blade cartridge 102 rotates in a rearward direction to the first direction (hereinafter referred to as a rearward direction), the second razor blade 125*b* cuts hair.

The top housing 121*a* is coupled to the bottom housing 123 so as to surround a periphery of the bottom housing 123. To couple the top housing 121*a* to the bottom housing 123, coupling protrusions 121*c* protrude from an inside of a lower portion of the top housing 121*a*, and coupling grooves 123*a* are formed in a lower portion of the bottom housing 123. When the top housing 121*a* is coupled to the bottom housing 123, the coupling protrusions 121*c* engage with the coupling grooves 123*a* to fasten the top housing 121*a* and the bottom housing 123.

Also, if the top housing 121*a* is coupled to the bottom housing 123, the top housing 121*a* surrounds an end portion of the holding part 127. Here, the end portion is adjacent to an outer circumference surface of the bottom housing 123 in a front surface of the bottom housing 123. That is, the top housing 121*a* is coupled to the bottom housing 123, and at the same time, fixes the razor blade assemblies 125 to the holding part 127.

The housing cover 121*b* is coupled to a central portion of a front surface of the bottom housing 123. To couple the housing cover 121*b* to the bottom housing 123, other coupling grooves (hereinafter referred to as a second coupling groove) 123*b* are formed in the bottom housing 123, and hooks 121*d* extending from an inner surface of the housing cover 121*b* to a lower portion are formed in the housing cover 121*b*. In the embodiment, each of the second coupling grooves 123*b* is formed in an inner surface of the holding part 127. If the housing cover 121*b* is coupled to the bottom housing 123, the hooks 121*d* engage with the second coupling grooves 123*a* to fasten the housing cover 121*b* to the bottom housing 123.

Moreover, the housing cover 121*b* surrounds other end portion of the holding part 127 when the housing cover 121*b* is being coupled to the bottom housing 123. Here, the other end portion is disposed in a central portion of the bottom housing 123. That is, the housing cover 121*b* is coupled to the bottom housing 123, and at the same time, fixes the razor blade assemblies 125 to the holding part 127.

As a result, a state where the razor blade assemblies 125 are coupled to the bottom housing 123 may be maintained by the top housing 121*a* and the housing cover 121*b*.

The razor blade cartridge 102 may be configured so as to be interchangeable. That is, after the cartridge cover 104 is separated from the body 101, the razor blade cartridge 102 can be replaced.

The cartridge cover 104 is coupled to the body 101 by using a screw method when the cartridge cover 104 is surrounding a periphery of the razor blade cartridge. Therefore, before shaving, a user can turn the cartridge cover 104 such that the cartridge cover 104 becomes farther away from or closer to a front surface of the razor blade cartridge 102. That is, a user can adjust a protruding degree of the cartridge cover 104 with respect to the razor blade cartridge 102, and thus, degree of skin expansion in shaving region can be adjusted. Moreover, during shaving, user's skin contacts the razor blade cartridge 102 in a central portion of the razor blade cartridge 102 by greater force, more tightly than in a region pressed by the cartridge cover 104. Therefore, when the razor blade cartridge 102 rotates, greater frictional force occurs between the central portion of the razor blade cartridge 102 and user's skin. Therefore, to moderate friction between the central portion of the razor blade cartridge 102 and user's skin to smoothly shave when the razor blade cartridge 102 rotates, the housing cover 121*b* may be manufactured of a material, such as Teflon having lubricity. The housing cover 121*b* may be manufactured of any material if the material could be used as a lubricating band, and thus, the housing cover 121*b* does not necessarily need to be manufactured of Teflon.

A configuration, where five razor blade assemblies 125 are disposed at an equal-angle distance in the razor blade cartridge 102, is described and shown, but as described above, one pair of the razor blade assemblies 125 may be disposed, three or four razor blade assemblies 125 may be disposed, or five or more razor blade assemblies may be disposed in the razor blade cartridge 102. It will be apparent to those skilled in the art that because the razor blade cartridge 102 rotates in the embodiment, when two or more razor blade assemblies 125 are disposed, the razor blade assemblies has to be disposed at an equal distance, and thus, a center of gravity has to match a rotary shaft of the razor blade cartridge 102 when the razor blade cartridge 102 rotates.

Moreover, in the embodiment, a configuration, where one razor blade assembly 125 occupies every lengthwise position of radius direction of the razor blade cartridge 102, is described and shown, but a plurality of razor blade assemblies 125 may be disposed along the radius direction of the razor blade cartridge 102. However, the blades of razor blades configuring the razor blade assembly 125 have to be disposed so as to face the rotary direction of the razor blade cartridge 102. Here, the rotary direction of the razor blade cartridge 102, as described above, may be a forward direction or a rearward direction. Also, when a rotary direction of the razor blade cartridge 102 can be selected, as described in the exemplary embodiment, the first razor blade 125*a* and the second razor blade 125*b* may be disposed so as face each other in the razor blade cartridge assembly.

Figure 8:
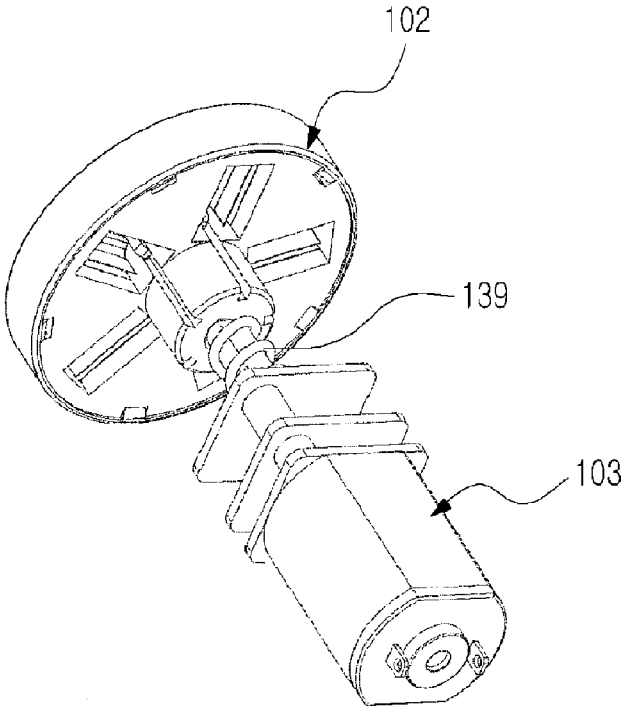
FIG. 8 is a perspective view illustrating a razor blade cartridge which is included in the electric rotary razor shown in FIG. 7 and is coupled to a motor.
Figure 9:
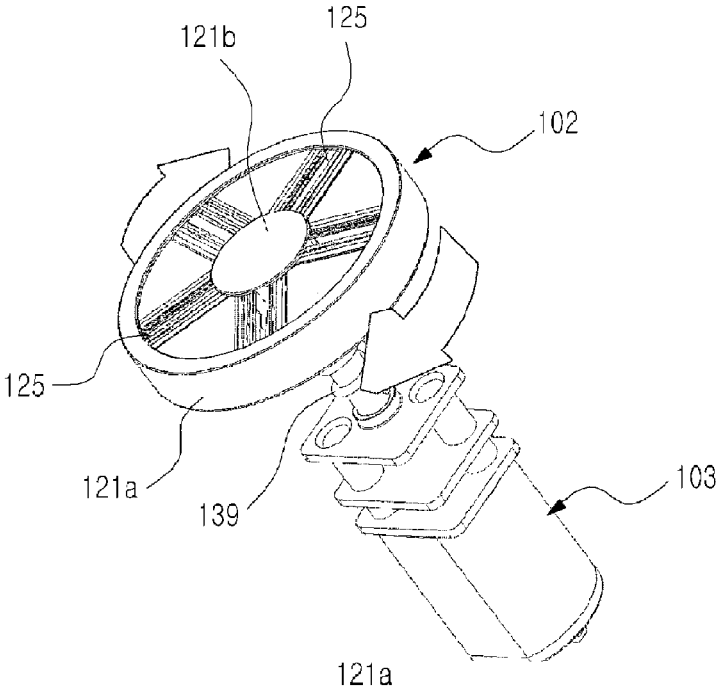
FIG. 9 is a perspective view illustrating a razor blade cartridge which is shown in FIG. 8 and rotates in one direction.
Figure 10:
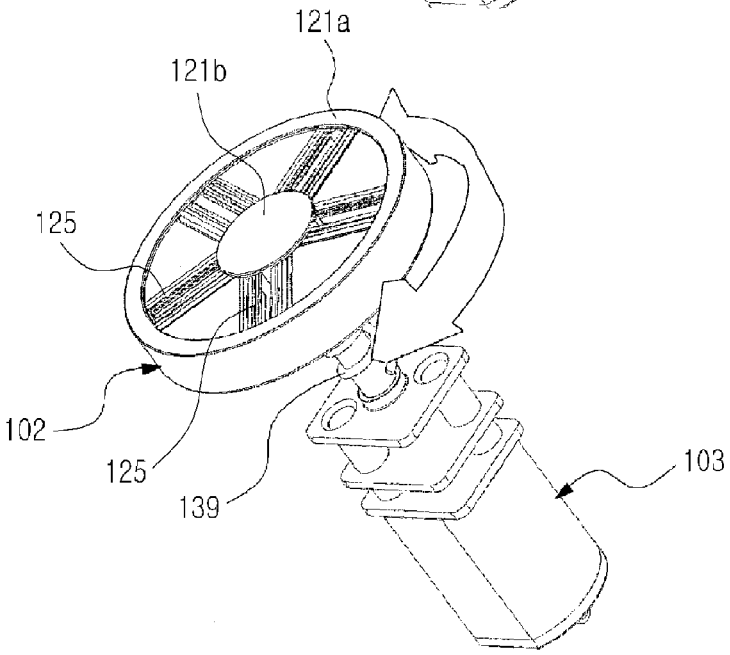
FIG. 10 is a perspective view illustrating a razor blade cartridge which is shown in FIG. 8 and alternately rotates forward and rearward.

FIG. 8 illustrates a razor blade cartridge 102 coupled to a motor 103, FIG. 9 illustrates a razor blade cartridge 102 rotating in one direction, and FIG. 10 illustrates a razor blade cartridge 102 alternately rotating forward and rearward.

As described above, the first and second razor blades 125*a* and 125*b* are disposed so as to face each other in the razor blade cartridge 102, and thus, it is possible to shave even though the razor blade cartridge 102 rotates in any direction. Also, it is possible to shave even though the razor blade cartridge 102 alternately rotates forward and rearward. This may be set in various types depending on a configuration of a control circuit mounted on the circuit board 105, and a rotary speed of the razor blade cartridge 102 can be also controlled.

Figure 11:
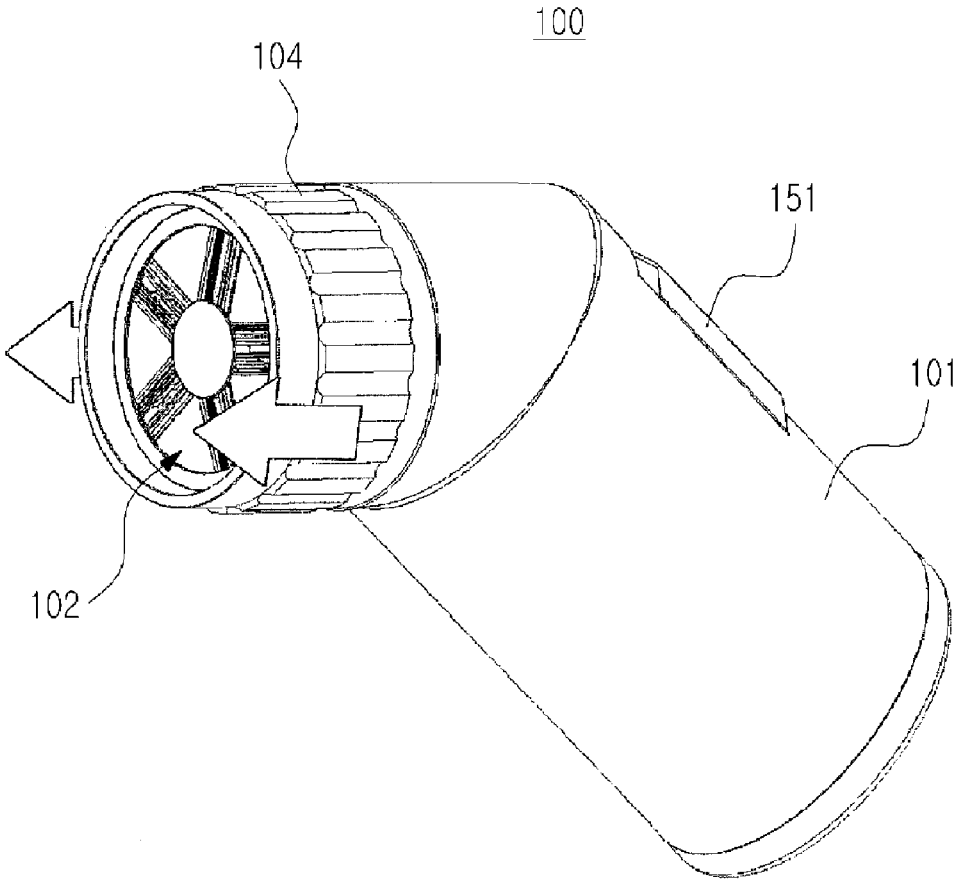
FIG. 11 is a perspective view illustrating a moving state of a cartridge cover of the electric rotary razor shown in FIG. 2.

FIG. 11 illustrates a cartridge cover 104 moving along a lengthwise direction of a rotary shaft of the razor blade cartridge 102. As described above, the cartridge cover 104 can move in a lengthwise direction of the rotary shaft of the razor blade cartridge 102 when the cartridge cover 104 is being disposed so as to surround a periphery of the razor blade cartridge 102. As described above, this is possible because the cartridge cover 104 is coupled to the body 101 by using a screw method. If the cartridge cover 104 moves in the lengthwise direction of the rotary shaft of the razor blade cartridge 102, an end portion of the cartridge cover 104 becomes closer to or farther away from a front surface of the razor blade cartridge 102.

As shown in FIG. 11, when the cartridge cover 104 moves forward along the lengthwise direction of the rotary shaft of the razor blade cartridge 102, the end portion of the cartridge cover 104 becomes farther away by a certain distance from the front surface of the razor blade cartridge 102, and thus, it is possible to shave when a tauter skin is being maintained in a portion of user's skin. Therefore, user can shave clearly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. An electric rotary razor operated by a motor, the electric rotary razor comprising:

a razor blade cartridge turned by a motor; and at least two razor blade assemblies disposed at an equal-angle distance at the razor blade cartridge along a rotary direction of the razor blade cartridge, wherein, the razor blade cartridge comprises:

a bottom housing coupled to the motor to rotate depending on an operation of the motor;

a holding part formed in a front surface of the bottom housing to accommodate razor blades;

a top housing coupled to the bottom housing to surround a periphery of the bottom housing; and a housing cover coupled to a central portion of the bottom housing, the holding part is extended in a radius direction of the bottom housing, at least two holding parts are disposed along a circumference direction of the bottom housing, each of the razor blade assemblies comprises a first razor blade and a second razor blade disposed along a radius direction of the razor blade cartridge, each of the first razor blade and the second razor blade comprises razor blades arranged in an overlapping manner, and the first razor blade and the second razor blade are disposed to face each other.

2. The electric rotary razor of claim 1, wherein, the razor blade cartridge rotates in a forward direction and a rearward direction, and the blades of the first razor blade or the blades of the second razor blade are disposed to face a rotary direction of the razor blade cartridge.

3. The electric rotary razor of claim 2, wherein the motor turns the razor blade cartridge in a forward direction or a rearward direction, or alternately turns the razor blade cartridge in a forward direction and a rearward direction.

4. The electric rotary razor of claim 1, wherein, the first razor blade or the second razor blade are disposed by a distance in the range of from 0.3 mm to 1.0 mm.

5. The electric rotary razor of claim 1, wherein, the first razor blade and the second razor blades are disposed on the same plane as a front surface of the razor blade cartridge, or disposed on a plane lower or higher than the same plane as the front surface of the razor blade cartridge by a range of 0.1 mm or less.

6. The electric rotary razor of claim 1, wherein, the top housing surrounds an end portion of the holding part in a position adjacent to an outer circumference surface of the bottom housing, the housing cover surrounds other end portion of the holding part in a central portion of the bottom housing, and thus, the razor blades accommodated in the holding part are fixed to the holding part.

7. The electric rotary razor of claim 1 further comprising:

a coupling groove formed in an inner surface of the other end portion of the holding part; and a hooks extending from an inner surface of the housing cover to a lower portion, wherein, the hook is coupled to the coupling groove to fix the housing cover to the bottom housing.

8. The electric rotary razor of claim 1, wherein, the housing cover is manufactured of a material having lubricity.

9. The electric rotary razor of claim 1, wherein, the motor turns the razor blade cartridge in a forward direction or a rearward direction, or alternately turns the razor blade cartridge in a forward direction and a rearward direction.

10. The electric rotary razor of claim 9 further comprising:

a circuit board on which a control circuit controlling the motor and a switch module are mounted, wherein, the motor is driven according to a control of the control circuit to control a rotary direction of the razor blade cartridge.

11. The electric rotary razor of claim 1 further comprising:

a cartridge cover disposed for surrounding a periphery of the razor blade cartridge to move in a lengthwise direction of a rotary shaft of the razor blade cartridge, wherein, as the cartridge cover moves along the lengthwise direction of a rotary shaft of the razor blade cartridge, an end portion of the cartridge cover becomes closer to or farther away from a front surface of the razor blade cartridge.

12. The electric rotary razor of claim 1 further comprising:

a spring providing the razor blade cartridge with elastic force operating in a lengthwise direction of a rotary shaft of the razor blade cartridge, wherein, the elastic force of the spring brings the razor blade cartridge into contact with skin with constant force to maintain the contact state.

13. The electric rotary razor of claim 1, wherein, the razor blade cartridge is replaced with other razor blade cartridge.

* * * * *